US009969580B2

(12) United States Patent
Asada et al.

(10) Patent No.: US 9,969,580 B2
(45) Date of Patent: May 15, 2018

(54) CONVEYANCE APPARATUS AND PRINTING APPARATUS

(71) Applicants: Kohki Asada, Tokyo (JP); Masato Ogawa, Kanagawa (JP)

(72) Inventors: Kohki Asada, Tokyo (JP); Masato Ogawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days. days.

(21) Appl. No.: 15/644,009

(22) Filed: Jul. 7, 2017

(65) Prior Publication Data

US 2018/0016106 A1 Jan. 18, 2018

(30) Foreign Application Priority Data

Jul. 15, 2016 (JP) ..... 2016-140672
May 16, 2017 (JP) ..... 2017-097366

(51) Int. Cl.
*B65H 5/22* (2006.01)
*B41J 11/00* (2006.01)
*B65H 29/24* (2006.01)

(52) U.S. Cl.
CPC ..... *B65H 5/228* (2013.01); *B41J 11/002* (2013.01); *B41J 11/0015* (2013.01); *B65H 5/22* (2013.01); *B65H 29/24* (2013.01); *B65H 29/245* (2013.01); *B65H 2404/40* (2013.01)

(58) Field of Classification Search
CPC ..... B65H 5/22; B65H 5/228; B65H 29/24; B65H 29/245; B65H 2404/40; B41J 11/0015; B41J 11/002
See application file for complete search history.

(56) References Cited

U.S. PATENT DOCUMENTS

2013/0222502 A1* 8/2013 Kobayashi ..... B41M 5/0017 347/102

FOREIGN PATENT DOCUMENTS

| | | |
|---|---|---|
| JP | 2009-226811 | 10/2009 |
| JP | 2010-137406 | 6/2010 |
| JP | 2010-149417 | 7/2010 |
| JP | 2013-047136 | 3/2013 |

* cited by examiner

*Primary Examiner* — David H Bollinger
(74) *Attorney, Agent, or Firm* — Oblon, McClelland, Maier & Neustadt, L.L.P.

(57) ABSTRACT

A conveyance apparatus includes a conveyance device including a sheet-bearing member having a curved sheet-bearing surface, the conveyance device conveying a sheet by bearing the sheet with the curved sheet-bearing surface of the sheet-bearing member, and a blower to blow air onto the sheet. The carved sheet-bearing surface of the sheet-bearing member is formed by a plurality of wires defining gaps through which the blower blows air.

9 Claims, 11 Drawing Sheets

CONVEYANCE APPARATUS AND PRINTING APPARATUS

CROSS-REFERENCE TO RELATED APPLICATIONS

This patent application is based on and claims priority pursuant to 35 U.S.C. § 119(a) to Japanese Patent Application No. 2016-140672, filed on Jul. 15, 2016, and Japanese Patent Application No. 2017-097366, filed on May 16, 2017, in the Japan Patent Office, the entire disclosures of which are hereby incorporated by reference herein.

BACKGROUND

Technical Field

Aspects of this disclosure relate to a conveyance apparatus and a printing apparatus incorporating the conveyance apparatus.

Related Art

A conveyance apparatus is known that includes a conveyance unit and a blower. The conveyance unit includes a sheet-bearing member for bearing a sheet with a curved surface of the sheet-bearing member. The conveyance unit conveys the sheet while bearing the sheet with the curved surface of the she member. The blower blows air onto the sheet.

SUMMARY

In one aspect of this disclosure, a novel conveyance apparatus includes a conveyance device including a sheet-bearing member having a curved sheet-bearing surface for bearing a sheet and a blower to blow air onto the sheet. The curved sheet-bearing surface of the sheet bearing member is formed by a plurality of wires defining gaps through which the blower blows air.

In another aspect of this disclosure, a novel printing apparatus includes a liquid discharge unit to discharge liquid onto a sheet, and a conveyance apparatus to convey the sheet on which the liquid is discharged by the liquid discharge unit while air is blown onto the sheet.

In still another aspect of this disclosure, a novel printing apparatus includes a liquid discharge unit to discharge liquid onto a sheet, a pre-processing unit to apply treatment liquid to the sheet before the liquid is discharged onto the sheet, and a conveyance apparatus to convey the sheet on which the treatment liquid is discharged by the pre-processing unit while air is blown onto the sheet.

BRIEF DESCRIPTION OF THE DRAWINGS

The aforementioned and other aspects, features, and advantages of the present disclosure will be better understood by reference to the following detailed description when considered in connection with the accompanying drawings, wherein.

Figure 1:
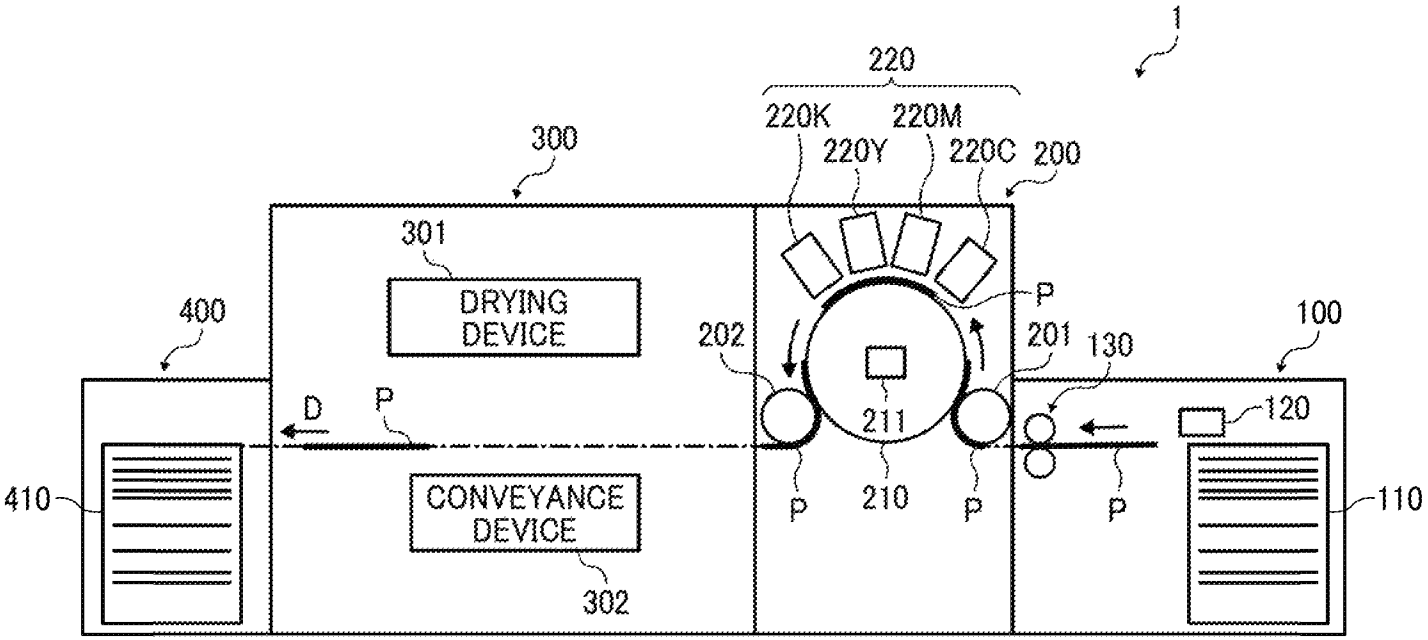
FIG. 1 is a schematic view of an inkjet recording apparatus according to an a embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes call technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a", "an", and "the" are intended to include the plural forms as well, unless the context clearly indicates otherwise.

Referring now to the drawings, wherein like reference numerals designate identical or corresponding parts throughout the several views, embodiments of the present disclosure are described below.

FIG. 1 is a schematic diagram of an inkjet recording apparatus according to an embodiment of the present disclosure.

The inkjet recording apparatus 1 of the present embodiment includes a sheet-feeding unit 100, an image forming unit 200, a drying unit 300, and a sheet-ejection unit 400. The inkjet recording apparatus 1 forms an image on a sheet P of recording material, which is fed from the sheet-feeding unit 100, with the image forming unit 200. The image forming unit 200 discharges ink onto the sheet P to form an image on the sheet P. Then, the drying unit 300 dries the ink adhering to the sheet P and the sheet ejection unit 400 ejects the sheet P from the inkjet recording apparatus 1.

Sheet Feeding Unit

The sheet-feeding unit 100 includes a sheet-feed tray 110 on which a plurality of sheets P is stacked, a sheet feeder 120 to separate and feed the sheets P one by one from the sheet-feed tray 110, and paired registration rollers 130 to convey the sheet P to the image forming unit 200. As the sheet feeder 120 any sheet feeder, such as a device using rollers or a device using air suction, can be used.

After the leading end of the sheet P fed from the sheet-feed tray 110 by the sheet feeder 120 reaches the paired registration rollers 130, the paired registration rollers 130 are driven at a predetermined timing to feed the sheet P to the image forming unit 200. In the present embodiment, the sheet-feeding unit 100 is not limited to the above-described configuration and may he any other configuration capable of conveying the sheet P to the image forming unit 200.

Image Forming Unit

The image forming unit 200 includes, for example, a transfer cylinder 201 to receive the fed Sheet P and transfer the fed sheet P is a sheet-bearing drum 210, a sheet bearing drum 210 to bear and convey the sheet P conveyed by the transfer cylinder 201 on an outer circumferential surface of the sheet-hearing drum 210, an liquid discharge unit 220 to discharge ink toward the sheet P borne on the sheet-bearing drum 210, and a transfer cylinder 202 to transfer the sheet P conveyed by the sheet-bearing drum 210 to the drying unit 300.

The leading end of the sheet P conveyed from the sheet-feeding unit 100 to the image forming unit 200 is gripped by a sheet gripper provided on the surface of the transfer cylinder 201 and conveyed with the movement of the surface of the transfer cylinder 201. The sheet P conveyed by the transfer cylinder 201 is delivered to the sheet-bearing drum 210 at a position facing the sheet-bearing drum 210.

The sheet gripper is also provided on the surface of the sheet-bearing drum 210, and the leading end of the sheet P is gripped by the sheet gripper. Multiple dispersed suction holes are formed in the surface of the sheet-bearing drum 210, and a vacuum directed toward the inside of the sheet-bearing drum 210 is generated in each suction holes by, a suction device 211. The leading end of the sheet P delivered from the transfer cylinder 201 to the sheet bearing drum 210 is gripped by the sheet gripper, and the sheet is attracted to the surface of the sheet-bearing drum 210 by the vacuum and is conveyed with the movement of the surface of the sheet-bearing drum 210.

The liquid discharge unit 220 according to the present embodiment discharges inks of four colors of C (cyan), M (magenta), (yellow), and K (black) to form an image, and includes individual liquid discharge heads 220C, 220N, 220Y and 220K for respective inks. The configurations of the liquid discharge heads 220C, 220M, 220Y, and 220K are not limited to the above-described configurations and may be any other suitable configurations. For example, a liquid discharge head to discharge special ink, such as white, gold, and silver, may be provided, or a liquid discharge head to discharge a liquid that does nut constitute an image, such as a surface coating liquid, may be provided as necessary.

The discharge operation of the liquid discharge heads 220C, 220M, 220Y, and 220K of the liquid discharge unit 220 is controlled by drive signals corresponding to image information. When the sheet P borne on the sheet-bearing drum 210 passes through a region opposed to the liquid discharge unit 220, ink of respective colors is discharged from the liquid discharge heads 220C, 220M, 220Y, and 220K to form an image in accordance with the image information. In the present embodiment, the image forming unit 200 is not limited to the above-described configuration and may be any other configuration of forming an image by causing liquid to adhere onto the sheet P.

Drying Unit

The drying unit 300 includes, for example, a drying device 301 to dry the ink adhered onto the sheet P by the image forming unit 200, and a conveyance device 302 to convey the sheet P conveyed from the image forming unit 200. After the sheet P conveyed from the image forming unit 200 is received by the conveyance device 302, the sheet P is conveyed to pass through the drying device 301 and delivered to the sheet-ejection unit 400. When passing through the drying device 301, the ink on the sheet P is subjected to a drying process. Thus, the liquid content, such as moisture, in the ink evaporates, and the ink is fixed on the sheet P. Therefore, the curl of the sheet P is reduced.

Sheet-Ejection Unit

The sheet-ejection unit 400 includes, for example, a sheet ejection tray 410 on which a plurality of sheet P is stacked. The sheet P conveyed from the drying unit 300 is sequentially stacked and held on the sheet ejection tray 410. The configuration of the sheet-ejection unit 400 is not limited to the above-described configuration and may be any other configuration capable of ejecting the sheet P.

Other Functional Units

Figure 9:
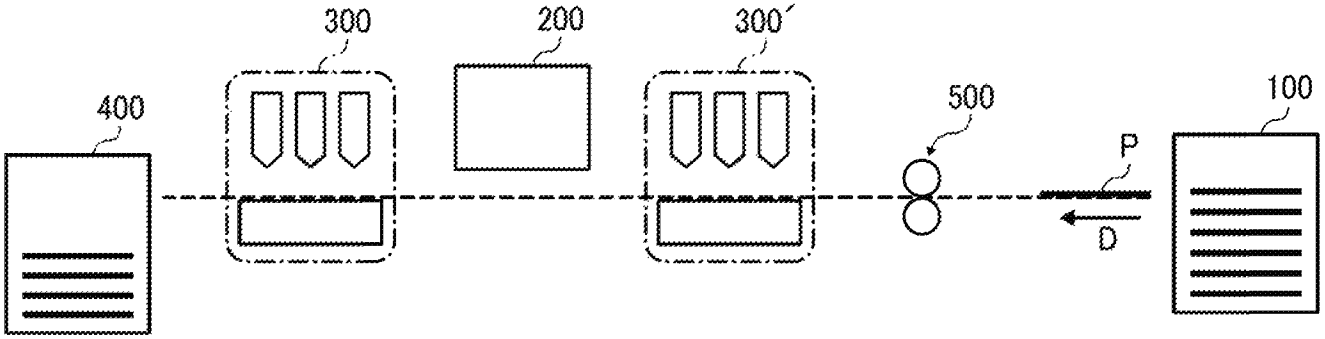
FIG. 9 is a schematic view of an inkjet recording apparatus in variation 2.

As described above, the inkjet recording apparatus 1 according to the present embodiment includes the sheet-feeding unit 100, the image forming unit 200, the drying unit 300, and the sheet-ejection unit 400. In addition, other functional units may be added as suitable. For example, as illustrated in FIG. 9, a pre-processing unit 500 to perform pre-processing of image formation can be added between the sheet-feeding unit 100 and the image forming unit 200, or a post-processing unit to perform post-processing of image formation can be added between the drying unit 300 and the sheet-ejection unit 400.

As the pre-processing unit 500, for example, there is a unit to perform a treatment liquid application process of applying a treatment liquid that reacts with ink to reduce bleeding of the ink on the sheet P. However, the pre-processing is not particularly limited to any specific content.

In addition, as the post-processing unit, for example, there is a sheet-reverse-conveyance processing, or a binding process for binding, a plurality of sheets on which the image is formed, and the like. The sheet-reverse-conveyance processing reverses the sheet P, on which the image is formed by the image forming unit 200, and conveys the reversed sheet to the image forming unit 200 again to form images on both sides of the sheet P. However, the post-processing is also not particularly limited to any specific content.

In addition, although an inkjet recording apparatus is used as an example of a printing apparatus in the present embodiment, the printing apparatus is not limited to such an apparatus to form meaningful images, such as letters or figures, on a dried surface of the sheet material with discharged liquid. For example, the printing apparatus may be an apparatus to form meaningless images, such as meaningless patterns, or fabricate three-dimensional images.

Examples of the sheet material on which liquid can be adhered include any materials on which liquid can be adhered even temporarily, such as paper, thread, fiber, fabric, leather, metal, plastic, glass, wood, and ceramic.

For example, the sheet materials used for film products, cloth products, such as clothing products, building materials, such as a wall sheet or flooring materials, leather products, and the like may be used.

The printing apparatus may include devices to feed, convey, and eject the medium on which can adhere. The printing apparatus may further include a pretreatment apparatus to coat a treatment liquid onto the medium before an image formation process, and a post-treatment apparatus to coat a treatment liquid onto the medium, onto which the liquid has been discharged.

Further, the term "liquid" includes any liquid haying a viscosity or a surface tension that can he discharged from the head. However, preferably, the viscosity of the liquid is not greater than 30 mPa•s under ordinary temperature and ordinary pressure or by heating or cooling.

More specifically, the term "liquid" is, for example, solution, suspension, emulsion or the like that includes a solvent, such as water or an organic solvent a colorant, such as a dye or a pigment, a functionalizing material, such as a polyene table compound, a resin, or a surfactant, a biocompatible material, such as DNA, amino acid, protein, or calcium, edible materials, such as natural pigments, and the like. Such liquids can be used, for example, for inkjet inks, surface treatment liquids and the like.

The term "printing apparatus" may be an apparatus to move a liquid discharge head and a sheet material on which liquid can be adhered. However, the liquid discharge apparatus is not, limited to such an apparatus. For example, the printing apparatus may be a serial head apparatus that moves the liquid discharge head or a line head apparatus that does not move the liquid discharge head.

The term "liquid discharge head" used herein is a functional component to discharge or jet liquid from nozzles. "A liquid discharge head" includes an energy source. Examples of the energy source for generating energy to discharge liquid include a piezoelectric actuator (a laminated piezoelectric element or a thin-film piezoelectric element), a thermal actuator that employs a thermo-electric conversion element, such as a heating element, and an electrostatic actuator including a diaphragm and opposed electrodes.

Details of Drying Unit

Next, the drying unit 300 according to the present embodiment is described below in further detail.

Figure 2:
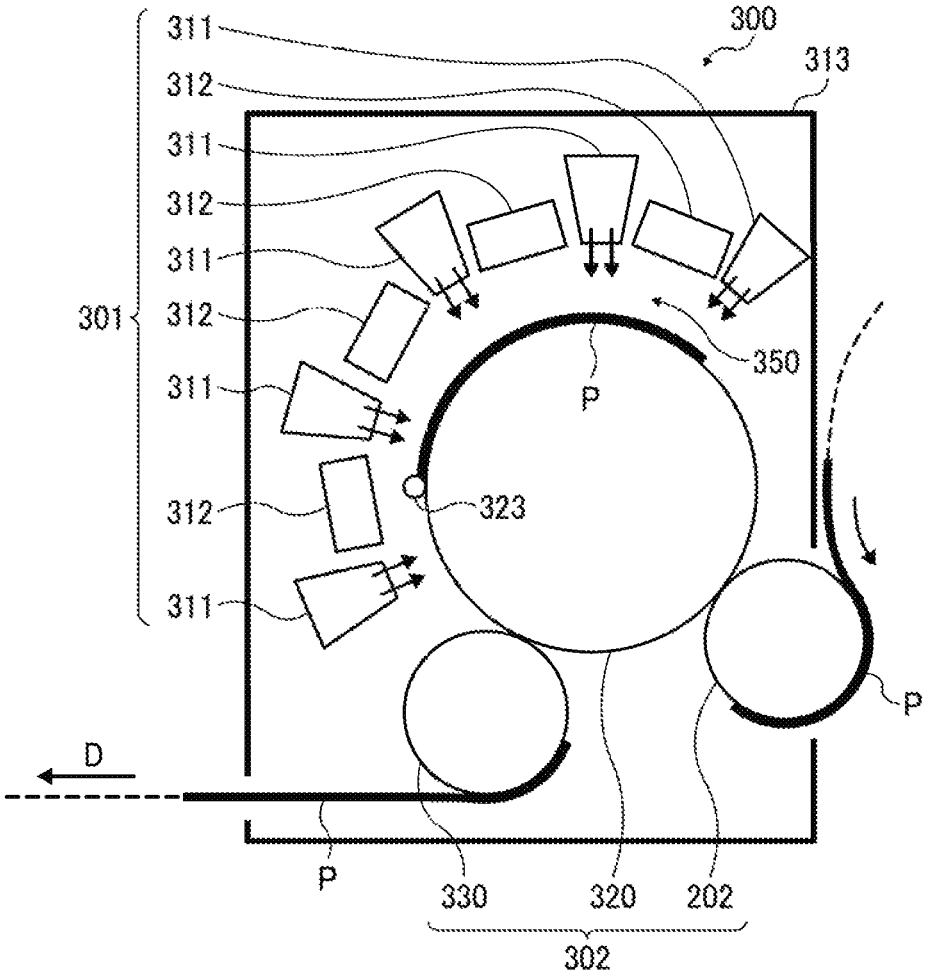
FIG. 2 is a schematic cross-sectional view of a drying unit of the inkjet recording apparatus of FIG. 1.

FIG. 2 is a schematic diagram of the drying unit 300 according to the present embodiment.

The drying device 301 of the drying unit 300 in the present embodiment includes blower fans 311 and irradiation heaters 312. The blower fans 311 blow air onto the sheet P that is conveyed by the conveyance device 302. The blower fans 311 and the irradiation heaters 312 may be arranged inside at drying chamber 313. At least a part of the wall material of the drying chamber 313 is made of an insulator to prevent the temperature decrease inside the drying chamber 313.

The drying device 301 dries the ink on the imaging surface of the sheet P with the heat generated by the irradiation heater 312 and the air blown by the blower fan 311 against the imaging surface (the surface on which the liquid such as the ink is applied) of the sheet P conveyed by the conveyance device 302.

In the example illustrated in FIG. 2 not only the blower fans 311 and the irradiation heaters 312, but also the conveyance device 302 are disposed inside the drying chamber 313. Alternatively, however, as illustrated in FIG. 3, the conveyance device 302 may be disposed outside the drying chamber 313, with the blower fans 311 and the irradiation heaters 312 arranged inside the drying chamber 313.

In the example illustrated in FIG. 2, even if the air blown from the blower fan 311 travels through the drum 320, the embodiment depicted in FIG. 2 can prevent the air from influencing other units such as liquid discharge unit 220.

Figure 3:
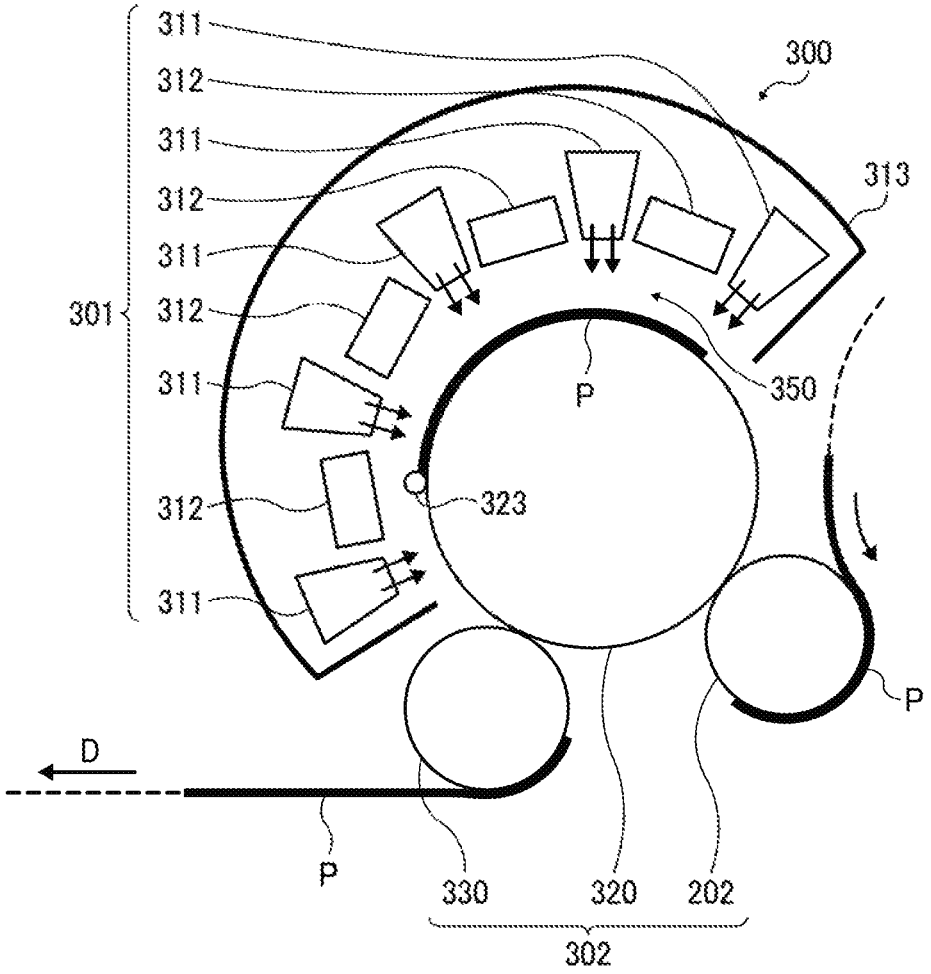
FIG. 3 is a schematic cross-sectional view of another configuration of the drying unit of the inkjet recording apparatus of FIG. 1.

In the example illustrated in FIG. 3, a space inside the drying chamber 313 that is heated by the drying device 301 is smaller than a space inside the drying chamber in. FIG. 2. As a result, it is easy to increase the temperature inside the drying chamber 313 according to the embodiment depicted in FIG. 3.

The drying device 301 according to the present embodiment has a configuration in which five of the blower fans 311 are disposed along a sheet conveyance direction indicated by arrow D in FIG. 3. However, numbers and arrangement of the blower fans 311 are not limited to the above-described configuration and may be any other configuration capable of blowing the air onto the sheet P.

Similarly, the drying device 301 according to the present embodiment has a configuration in which four of the irradiation heaters 312 are disposed in a sheet conveyance direction D. However, numbers and arrangement of the irradiation heaters 312 are not limited to the above-described configuration and may be any other configuration capable of heating and drying the ink on the sheet P.

The conveyance device 302 according to the present embodiment includes, a drum 320 and a transfer cylinder 330 as shown in FIG. 2 and FIG. 3. The drum 320 receives the sheet P fed from the transfer cylinder 202 of the image forming unit 200 and conveys the sheet P by bearing the sheet P with an outer circumferential surface of the drum 320. The drum 320 acts as a sheet-bearing member. The transfer cylinder 330 transfers the sheet P conveyed by the drum 320 to the sheet-ejection unit 400.

The sheet P conveyed by the transfer cylinder 202 of the image forming unit 200 is delivered to the drum 320 at a position facing the drum 320. As similar to the sheet-hearing drum 210 of the image forming unit 200, a sheet gripper 323 is provided on the surface of the drum 320, and the leading end of the sheet P is gripped by the sheet gripper 323.

The leading end of the sheet P delivered from the transfer cylinder 202 to the drum 320 is gripped by the sheet gripper 323. The sheet P is borne on an outer circumferential surface (curved sheet-bearing surface) of the drum 320 and is conveyed along a circumferential direction of the drum 320 with the movement of the surface of the drum 320.

As illustrated in FIG. 2, the blower fans 311 and the irradiation heaters 312 of the drying device 301 are disposed around the circumference of the drum 320 to face the outer circumferential surface of the drum 320. The sheet P borne on the outer circumferential surface of the drum 320 passes through a blowing area 350 with the movement of the surface of the drum 320. The air heated by the irradiation heater 312 is blown to the blowing area 350 by the blower fan 311.

Then, the sheet P borne by the outer circumferential surface of the drum 320 is delivered to the transfer cylinder 330 at the position facing the transfer cylinder 330, and the sheet P is delivered from the transfer cylinder 330 to the sheet-ejection unit 400.

Sheet Stabilization

Generally, when the drum 320 has a curved outer circumferential surface (curved sheet-bearing surface) that bears the sheet, as in the present embodiment, the sheet borne on the outer circumferential surface wraps around the curved outer circumferential surface of the drum.

The ends (the leading end or trailing end) of the sheet tend to float (separate) from the outer circumferential surface of the drum 320 because a restoration force acts on the wrapped (bent) sheet. The restoration force forces the sheet to return to a status that is not wrapped (bent) by the stiffness of the sheet.

When the air is blown toward the sheet borne on the drum 320 in a wrapped (bent) status from an outer surface side of the sheet by the blower fan 311, the air is easily enter from the end of the sheet toward a portion between a back face of the sheet and the outer circumferential surface of the drum 320.

Thereby, the end of the sheet is curled up or flapped by the air, and it causes a conveyance failure of the sheet.

A conventional drum generally conveys a sheet by bearing sheet on an outer circumferential surface of the drum that does not have holes or groove on the outer circumferential surface of the drum. Further, a conventional drum conveys the sheet by absorbing the sheet with the suction three applied from suction holes provided on the outer circumferential surface of the drum.

In this type of conventional drum, an airflow is generated by the air from a blower fan. The air from the blower fan hits on a portion of the outer circumferential surface of the drum that does not bear the sheet, and this portion is located downstream from the leading end of the sheet borne by the drum in the sheet conveyance direction. The airflow flows downstream in the sheet conveyance direction along the outer circumference snake of the drum. In this case, this airflow may cause a leading end of the sheet to be curled up or flapped by the airflow.

Further, for example, an airflow may be generated by the air from a blower fan. The air from the blower fan hits on a portion of the outer circumferential surface of the drum that does not bear the sheet. The portion is located upstream from the trailing end, of the sheet borne by the dram in the sheet conveyance direction. The airflow flows toward an upstream side in the sheet conveyance direction along the outer circumference surface of the drum. In this case, this airflow may cause a trailing end of the sheet to be curled up or flapped by the airflow.

Further, for example, an airflow may be generated by the air from a blower fan. The air from the blower fan hits on a portion of the outer circumferential surface of the drum that does not bear the sheet. The portion is located outside of the ends of the sheet borne by the drum in the axial direction of the drum. The airflow flows toward inside the drum in the axial direction of the drum along the outer circumference surface of the drum. In this case, this airflow may cause the side ends of the sheet to be curled up or flapped by the airflow.

In some ink drying apparatus, a plurality of disks is fixed on a rotation axis of a drum with gaps with each other in order to increase an area of heat radiation of the ink drum. Each circumferential surface of the disks constitutes a sheet-bearing surface that bears the sheet. In this ink drying apparatus, some of the hot air strikes the circumference of the sheet from a hot air nozzle (blower) passes through the gaps between the plurality of the disks that constitutes the ink drum, thereby the airflow that flows along an outer circumference of the drum is not generated.

However, the rest of the hot air blows around the circumference of the sheet from the hot air nozzle generates the airflow flowing along the outer circumference of the drum as similar to the above-described ink drum. The hot air hits on the circumference surface of each disks to generate the airflow. This airflow may cause the end of the sheet to be curled up or flapped.

Figure 4:
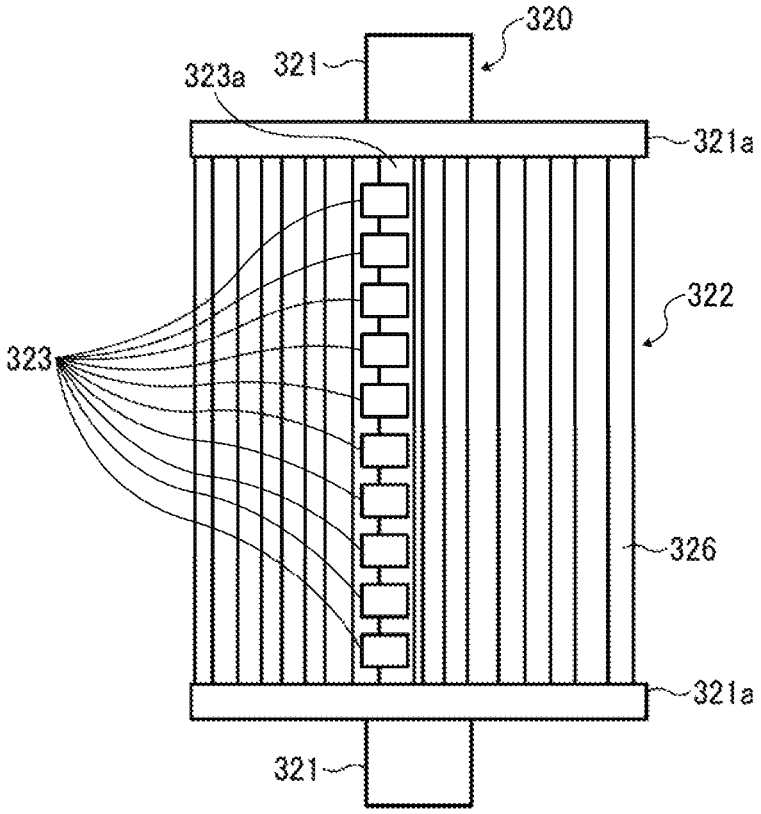
FIG. 4 is a plan view of a drum of the drying unit.

FIG. 4 is a plan view of a drum 320 of a drying unit 300 according to the present embodiment.

In the present embodiment, the outer surface of the drum 320 includes a plurality of supporting wires 322 disposed on the outer circumferential surface (curved sheet-bearing surface) of the drum 320 (sheet-bearing member) such that the plurality of supporting wires 322 is separated by gaps 326 in the circumferential direction of the drum 320.

Thus, the outer surface (curved sheet-bearing surface) of the drum 320 (sheet-bearing member) is formed by a plurality of wires 322 defining gaps 326 through which the blower fan 311 (blower) blows air.

As a result, the air that strikes the circumference of the sheet P borne on the outer circumferential surface of the drum 320 passes through the outer circumferential surface of the drum 320 by passing through the gaps 326 between the supporting wires 322. As illustrated in FIG. 4, the drum 320 includes two disk-shaped flanges 321*a*, each end facing in an axial direction of the drum 320, The flanges 321*a* are connected to the drum shaft 321 of the drum 320.

The plurality of supporting wires 322 extends in a drum-axial direction and is tensioned between these flanges 321*a* at predetermined intervals along a circumference of the flanges 321*a*, The outer surface that bears the sheet in the drum 320 in the present embodiment includes these supporting wires 322.

Sheet grippers 323 on the drum 320 are mounted on a gripper-supporting member 323*a* that is supported between the two flanges 321*a*, An inner space inside the drum 320, that is, the space surrounded by the supporting wires 322 and two flanges 321*a*, is hollow except for the drum shaft 321.

Figure 5:
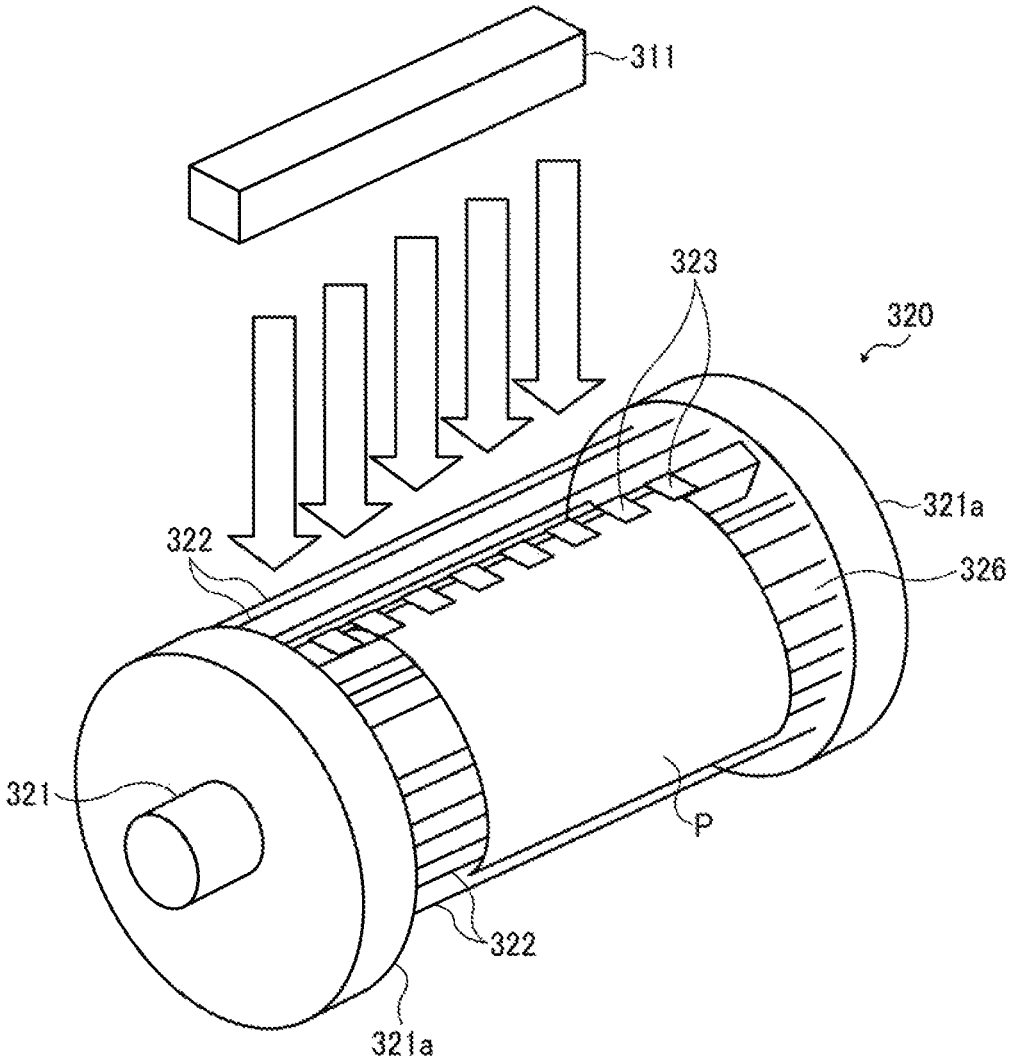
FIG. 5 is a perspective view of the drying unit illustrated in FIG. 4.

FIG. 5 is a perspective view of the drum 320 of a drying unit 300 according to the present embodiment. FIG. 5 illustrates the status where the blower fan 311 blows the air to the drum 320.

In the present embodiment, a back side of the sheet P that is borne and conveyed by the drum 320 is supported by the supporting wires 322 in a state in which a leading end of the sheet P is griped by the sheet grippers 323. Thereby, the drum 320 can convey the sheet P by bearing the sheet P on the outer circumferential surface of the drum 320 as similar to the conventional drum.

Thus, the drying unit 300 (conveyance apparatus) includes a conveyance device 302 including drum 320 (sheet-hearing member) having an outer circumferential surface (curved sheet-bearing surface) of the drum 320 (sheet-bearing member). The conveyance device 302 conveys the sheet P by supporting the sheet P on one side with the outer circumferential surface (curved sheet-hearing surface) of the drum 320 (sheet-bearing member). The drying unit 300 (conveyance apparatus) includes a blower fan 311 (blower) to blow the air onto the sheet P.

The outer circumferential surface (curved sheet-bearing surface) of the drum 320 (sheet-bearing member) includes a plurality supporting wires 322 (plurality of wires) having gaps 326 disposed between the plurality of supporting wires 322 (plurality of wires) so that the air blown from the, blower fan 311 (blower) to the sheet P is passable through the gaps 326.

Thus, the outer surface (curved sheet-bearing surface) of the drum 320 (sheet-bearing member) is formed by a plurality of wires 322 defining gaps 326 through which the blower fan 311 (blower) blows air.

In the present embodiment, the air from the blower fan 311 can pass through the gaps 326 between the supporting wires 322. Thus, the air that blows onto the sheet P borne on the drum 320 passes through the gaps 326 between the supporting wires 322 and enters inside the drum 320. Thereby, the drum 320 of the present embodiment does not generate the airflow that flows along the outer circumference of the drum 320.

Therefore, the present embodiment can prevent curling up and flapping of the end of the sheet P generated by the airflow flowing along the outer circumferential surface of the drum 320. Thus, the present embodiment can prevent a conveyance failure of the sheet P and achieve stable sheet conveyance.

Intervals between the supporting wires 322 (a separation distance in the circumferential direction of the drum 320) may be determined as appropriate. It is desirable to set the intervals such that the air from the blower fan 311 can pass therethrough, and the supporting wires 322 can support the sheet P without causing the sheet P to be bent greatly or to shift position even when the air from the blower fan 311 hits an imaging face (blown face) of the suffice of the sheet P.

Further, the diameter of the supporting wires 322 maybe set such that the air striking the supporting wires 322 does not substantially generate air currents or eddies along the outer circumference of the drum 320. Further, it is desirable to set the diameter of the supporting wires 322 sufficient to support the sheet P.

The supporting wires 322 in the present embodiment are metal wires having a diameter of 1 mm, but the material and the diameter of the wire is not limited to this embodiment. For example, the material used for the supporting wire may be rubber. There is no particular limitation on the type of material used for the supporting wires 322, provided that they function as intended.

In the present embodiment, heat-resistant material, such as heat-resistant rubber or metal) is preferably used with considering that high-temperature air heated by irradiation heater 312 is blown onto the supporting wires 322.

In the present embodiment, the plurality of supporting wires 322 forms a sheet-bearing surface of the drum 320 on which the sheet P is borne. The present embodiment has of an effect of preventing, a temperature increase of the sheet-bearing surface that contacts the back thee of the sheet P. Thus, the present embodiment that includes the plurality of supporting wires 322 has a smaller heat capacity and a greater total surface area than a conventional drum. Thus, the preset embodiment can reduce temperature increase of the sheet-bearing surface that contacts the back face of the sheet P even when hot air of a high temperature strikes the drum 320.

The configuration of the sheet-bearing surface formed by the plurality of supporting wires 322 is not limited to the configuration of the present embodiment if the air that strikes the circumference of sheet P home on the drum 320 can pass through the supporting wires 322.

Figure 6:
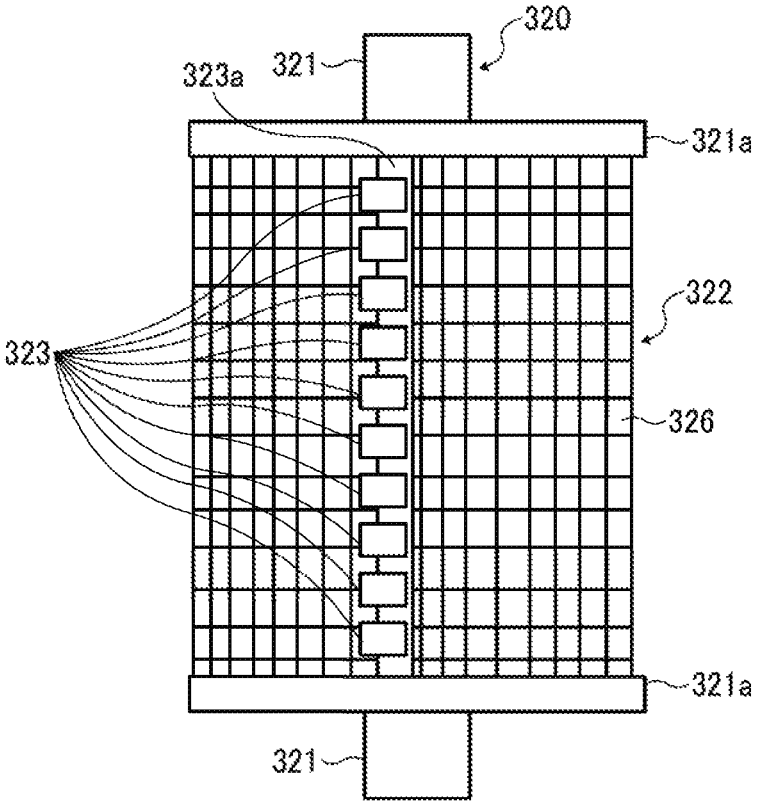
FIG. 6 is a plan view of another embodiment of a drum.

For example, as illustrated in FIG. 6, the supporting wires 322 may have a mesh structure in which the plurality of supporting wires 322 are orthogonally disposed. Instead of wires, a meshed-belt may be used for bearing the sheet P on the drum 320. In this type of mesh structure, the air that blows at circumference of the sheet P borne on the drum 320 passes through the gaps 326 between the supporting wires 322 and enters inside the drum 320. Thereby, the drum 320 illustrated in FIG. 6 does not generate the airflow that flows along the outer circumference of the drum 320.

Thus, in FIG. 6, the outer surface (curved sheet-bearing surface) of the drum 320 (sheet-bearing member) is formed by a plurality of wires 322 defining gaps 326 through which the blower fan 311 (blower) blows air.

Therefore, the present embodiment can prevent curling up and flapping of the end of the sheet P caused by the airflow flowing along the outer circumferential surface of the drum 320. Thus, the present embodiment can prevent a conveyance failure of the sheet P and achieves a stable sheet conveyance.

The drying unit 300 of the present embodiment does not necessarily include the irradiation heater 312 if the drying unit 300 has a configuration to blow the air against the sheet P with a blower such as blower fan 311. However, it is preferable to dry the ink on the sheet P with the air and irradiation heat in order to dry the ink in a short time.

A heater such as an infrared (IR) heater or a halogen heater may be used for the irradiation heater 312. Further, the air from the blower fan 311 may be heated with the irradiation heat of the irradiation heater 312. Further, the blower fan 311 may include built-in heater to blow a warm air (hot air).

A controller selects each type of parameters such as air speed and air volume of the air of the blower fan 311, a distance between the blower fan 311 and the outer circumference of the drum 320. Set values of each type of parameters are changed according to such as a type of sheet P, ink adhering amount on the sheet P, a sheet conveyance speed of the drum 320, for example.

The controller may change a set value of each type of parameters according to an input information input by the operator from an operation panel provided on the inkjet recording apparatus 1 according to the present embodiment, for example. Further, the controller may change a set value of each type of parameters using data or program previously stored inside a storage apparatus. Further, each type of parameters may be adjusted manually by the operator.

As similar to the blower fan 311, the controller may change a value of each type of parameters for irradiation beater 312 according to an input information input by the operator from an operation panel provided on the present inkjet recording apparatus, for example.

Parameters such as an output wavelength is changeably set according to such as a type of sheet P, ink adhering amount on the sheet P, a sheet conveyance speed of the drum 320, for the irradiation heater 312.

Further, the controller may change a set value of each type of parameters using data or program previously stored inside a storage apparatus. The parameters may be adjusted manually by the operator.

In the present embodiment, the interval of the blower fans 311 (separation distance between each blower fans 311 in the circumferential direction of the drum 320) maybe set as appropriate.

At this time, the present embodiment bears the sheet P on the drum 320 by pressing the sheet P onto, the outer circumferential surface (supporting wires 322) of the drum 320 with the air pressure of the air blown from the blower fan 311.

In this way, in case the force for bearing the sheet P on the drum 320 is obtained by the air pressure of the blower fan 311, it is desirable to set the intervals of the blower fans 311 such that the trailing end of the sheet P does not separate from the drum 320 by the stiffness of the sheet P. Specifically, it is preferable to set the intervals of the blower fans 311 such that the air pressure from the blower fan 311 can simultaneously press a piece of the sheet for at least three points of the leading end, the center, and the trailing end of the sheet P with the air pressure of the air from the blower fan 311.

In the configuration that uses the air pressure of the blower fans 311 for bearing the sheet P on the drum 320, the air speed of the blower fans 311 for preventing the separation of the sheet p from the drum 320 maybe set as appropriate according to the types of the sheet P. For example, the air speed is preferably equals to or greater than 20 m/s for the sheet P having relatively, greater stiffness.

In the present embodiment, the interval of the blower fans 311 (separation distance between each blower fans 311 in the circumferential direction of the drum 320) maybe set as appropriate. The sheet P receives an external three in a direction to be separated from the drum 320 by self-weight of the sheet P at the lower half portion of the drum 320. Thus, the sheet P is easily separated from the drum 320 when the trailing end of the sheet is conveyed to this lower half portion.

Thus, it is preferable to dispose the blower fans 311 such that the air from the blower fan 311 hits on a surface of sheet that passes through the lower half portion of the drum 320. Thus, it is preferable to arrange the blower fan 311 such that the air from the blower fan 311 hits the sheet-bearing surface that is located below the drum shaft 321 of the drum 320. The drum 320 acts as a rotational body, and the drum 320 acts as a rotational axis.

A pressing member such as a roller may be used for pressing the sheet P on the drum 320 to be borne by the drum 320. However, in this configuration of using the roller, image of the sheet P may be blurred when the image portion on the sheet P is pressed by the roller.

Thus, usually, the side ends portions of the sheet P (the portion of the sheet on which the image is not formed) is pressed by the pressing members. Because side end portions of the sheet P have width of only few millimeters, the sheet P may he separated from the pressing member when'the sheet P is shrunk by the drying process of the drying unit 300. Thereby, it is difficult to achieve stable sheet conveyance.

When the width (length in axial direction of the drum 320) of the sheet changes, it is necessary to adjust the pressing position of the pressing member according to the size of the sheet P.

Considering that the pressing member is subjected to the high temperature of the drying unit 300, the pressing member is required to have a sufficient heat resistance. Thus, the cost of the parts becomes expensive. in the present embodiment, the force for bearing the sheet P on the drum 320 is achieved by the air pressure from the blower fan 311. Therefore, it is not necessary to press the sheet P onto the drum 320 with the pressing member such as a roller.

Thus, the present embodiment can keep pressing the sheet P onto the drawn 320 with the air pressure of the blower fan 311 even when the sheet P is shrunk by the drying process of the drying unit 300. Thereby, the stable sheet conveyance can be achieved.

Further, it is not necessarily to adjust the position of the blower fan 311 even when the size of the sheet P in the width direction (length in the axial direction of the drum) is changed.

Further, it is not necessarily to secure non-imaging area to be pressed by the pressing member such as a roller on the sheet P. Thus, it is possible to make entire area of the sheet P to he an image area, and an image can be formed on an entire area of the sheet P.

Variation 1

Next, a first variation of the drying unit 300 according to the present embodiment is described below (the present variation is referred as "variation 1" or "first variation" in the following).

In the above-described embodiment, the inner space inside the drum 320 is empty except for, the drum shaft 321. The inner space inside the drum 320 is a space surrounded by the supporting wires 322 and the two flanges 321*a*.

Thus, the air blows from the blower fan 311 passes through the gaps 326 between the supporting wires 322 and enters inside the drum 320. Then, the air passes through the gaps 326 between the supporting wires 322 that constitute the opposite side of the outer circumferential surface of the drum 320 to go outside the drum 320. At this time, the air that goes outside the drum 320 may cause bad influence or malfunction on the sheet conveyance.

For example, when the sheet P is borne on the portion of the drum 320 where the air that passes through the gaps 326 between the supporting wires 322 that constitutes the opposite side of the outer circumferential surface of the drum 340, the air pressure of the air may cause the sheet P to be separated from the drum 320. Thereby, it may hamper the stable sheet conveyance.

Further, as described in the above embodiment, the blower fans 311 face across about semicircle of the drum 320. Thus, the air from the blower fans 311 from different directions may collide to generate turbulence. This turbulence may generate an un-expectable air that causes the sheet P to be separated from the drum 320.

Figure 8:
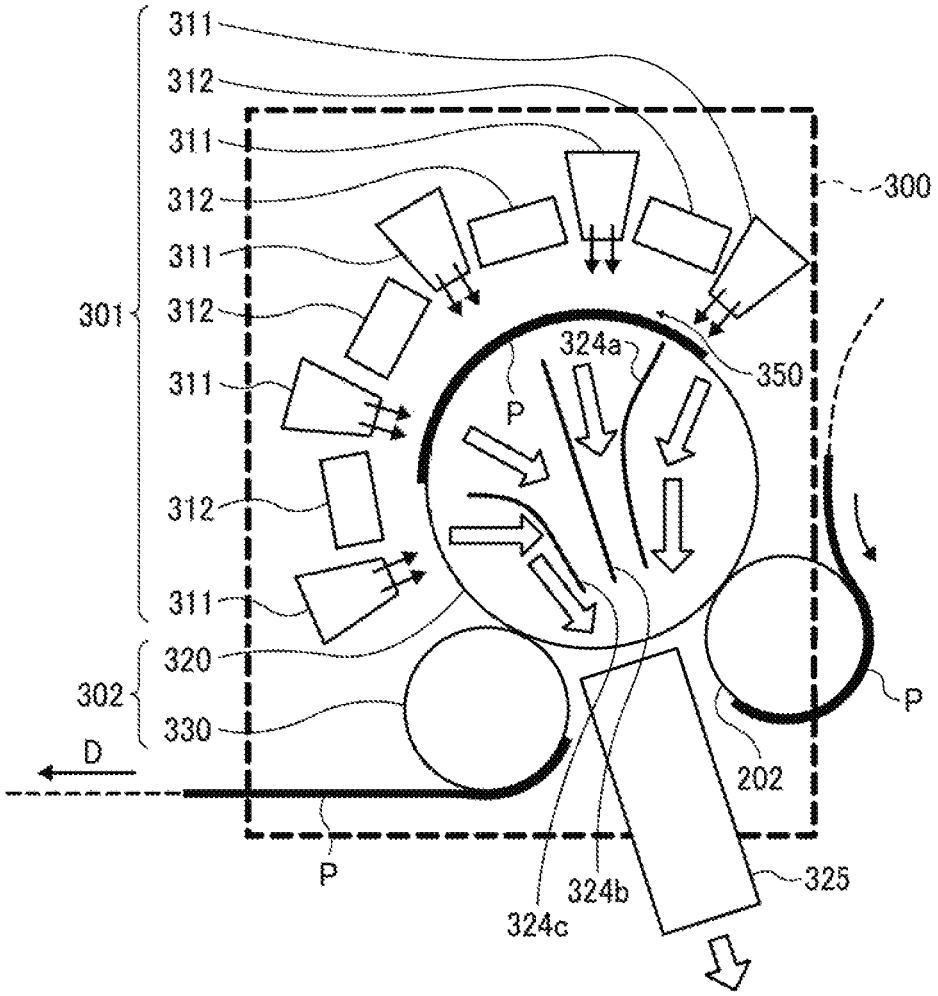
FIG. 8 is a schematic cross-sectional view of drying unit in variation 1.

FIG. 8 is a schematic cross-sectional view of the drying unit 300 according to the first variation (Variation 1).

As illustrated in FIG. 8, in the first variation, the drum 320 includes straightening vanes 324*a*, 324*b*, and 324*c* inside the drum 320. The straightening vanes 324*a*, 324*b*, and 324*c* act as a flow-channel forming member that forms a channel that guides the air that passed through the gaps 326 toward a predetermined destination.

Further, the drying unit 300 includes a discharge duct 325 that receives the air straightened by the straightening vanes 124*a*, 324*b*, and 324*c* and guides the air to a predetermined discharge destination such as outside the apparatus body (outside the drying unit 300).

These straightening vanes 324*a*, 324*b*, and 324*c* and the discharge duct 325 are functioned as a flow-channel forming member that forms a channel to guide the air to a predetermined destination. The air to be guided by the flow-channel forming member is entered from the gaps 326 between the supporting wires 322 of the drum 320 inside the interior space of the drum 320.

In the first variation, the first straightening vane 324*a* forms a channel that guides the air that blows from a first blower fan 311 to the outer circumferential surface of the drum 320. The first blower fan 311 is disposed at the most upper stream side in the sheet conveyance direction D. The air that blows from the first blower fan 311 is entered from the gaps 326 between the wires 322 of the drum 320 into the interior space of the drum 320.

The first straightening vane 324*a* guides the air entered inside the drum 320 to a portion of the drum 320 where the sheet P is not borne (non-bearing portion). Specifically, the portion locales at the outer circumferential surface of the drum 320 between a position that oppose to the transfer cylinder 330 of the drying unit 300 and a position that oppose'to the transfer cylinder 202 of the image forming unit 200. An entrance of the discharge duet 325 faces this portion of the outer circumference surface of the drum 320.

Thus, the air that blows from the blower fan 311 passes through the gaps 326 between the supporting wires 322 of the drum 320 and enters the interior space in the drum 320. Then, the air is straightened by the first straightening vane 324*a* and passes through the gaps 326 between the supporting wires 322 of the outer circumferential surface of the drum 320 that faces the entrance of the discharge duct 325. Then, the air flows outside the drum 320 and flows into the discharge duct 325.

As similar to the first straightening vane 324*a*, a third straightening vane 324*c* forms a channel that guides the air that blows from a fifth blower fan 311 to the outer circumferential surface of the drum 320 that faces the entrance of the discharge duct 325. The fifth blower fan 311 is disposed at the most downstream side in the sheet conveyance direction D, The air that blows from the fifth blower fan 311 is entered from the gaps 326 between the supporting wires 322 of the drum 320 into the interior space of the drum 320.

Thus, the air that blows from the fifth blower fan 311 passes through the gaps 326 between the supporting wires 322 and enters interior space of the drum 320. Then, the air is straightened by the third straightening vane 324*c* and passes through the gaps 326 between the supporting wires 322 that constitutes the outer circumferential surface of the drum 320 that faces the entrance of the discharge duct 325. Then, the air flows outside the drum 320 and flows into the discharge duct 325.

The second straightening vane 324*b* cooperates with the first straightening vane 324*a* and the third straightening vane 324*c* to form a channel that guides the air that blows from the remaining second to fourth blower fans 311 to the outer circumferential surface of the drum 320 that faces the entrance of the discharge duet 325. The second to fourth blower fans 311 are disposed between the first blower fan 311 and the fifth blower fan 311 in the sheet conveyance direction D.

The air that blows from the second to fourth blower fans 311 is entered from the gaps 326 between the supporting wires 322 of the drum 320 into the interior space of the drum 320. Thus, the air that blows from the remaining second to fourth blower fans 311 pass through the gaps 326 between the supporting wires 322 into the interior space in the drum 320. Then, the air is straightened by the straightening vanes 324*a*, 324*b*, and 324*c* and passes through the gaps 326 between the supporting wires 322 that face the entrance of the discharge duct 325. Then, the air flows outside the drum 320 and flows into the discharge duct 325.

Thus, in the first variation, the drying unit 300 (conveyance apparatus) includes straightening vanes 324*a* to 324*c* (a flow-channel forming member) that form channels that guide the air that enters an interior space of the drum 320 (endless moving member) by passing through gaps 326 disposed between the pluralities of supporting wires 322 (plurality of supporting wires 322) toward an non-bearing portion of the drum 320 (the endless moving member) on which the sheet P is not borne.

According to the first variation, the first straightening vane 324*a* can guide the air entered from the gaps 326 between the supporting wires 322 of the drum 320 into the interwar space of the drum 320 to the predetermined destination. Therefore, the first variation can reduce the had influence caused by the air entered into the interior space of the drum 320.

Variation 2

Next, a second variation of the drying unit 300 according to the present embodiment is described below (the present variation is referred as "variation 2" or "second variation" in the following).

In the above-described embodiment, the drying unit 300 that dries the sheet after forming image by discharging the ink is described as an example.

In the present variation, a treatment is performed in which a predetermined treatment liquid is imparted to the sheet P by, for example, application in the pre-processing unit. Before ink is discharged and an image is formed in the image forming unit 200, the sheet applied with the treatment liquid is dried in the drying unit 300.

FIG. 9 is a schematic diagram of an inkjet recording apparatus according to the second variation of the present disclosure.

The present variation has a same basic configuration with the above described embodiment except that the present variation includes a pre-processing unit 500 and a drying unit 300' between the sheet-feeding unit 100 and the image forming unit 200 of the inkjet recording apparatus 1 according to the above-described embodiment. Further, the basic configuration of the added drying, unit 300' is also the same as in the above-described drying unit 300.

Descriptions are given below of the second variation, focusing on the differences from the above-described embodiments.

Figure 10:
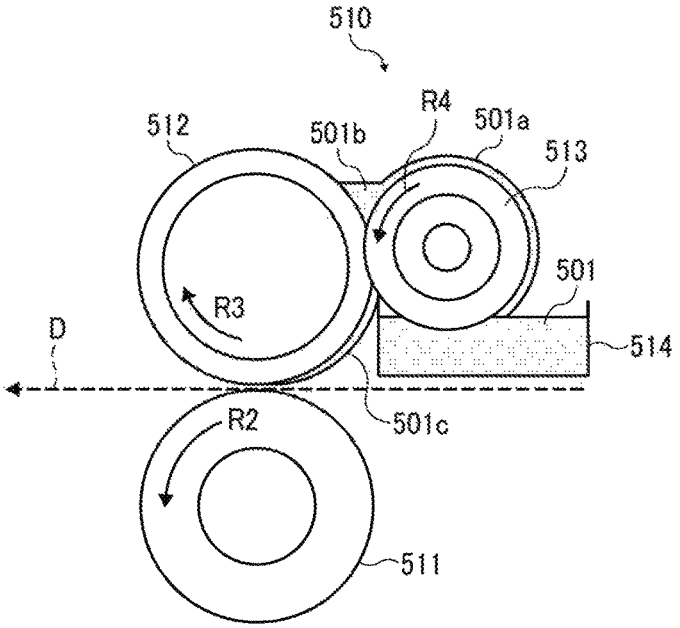
FIG. 10 is a schematic cross-sectional view of an application device used in the inkjet recording apparatus.

FIG. 10 is a schematic view of an application device 510 as the pre-processing unit used in the present variation 2.

The pre-processing unit 500 in the present variation includes the application device 510 to apply a treatment liquid to the sheet P fed from the sheet-feeding unit 100. As the treatment liquid, for example, there is a modifying material to modify the surface of the sheet by being applied to the surface of the sheet.

Specifically, there is a fixing agent (setting agent), in which, by preliminarily applying the fixing agent to the sheet uniformly, the moisture of the ink is quickly permeated into the sheet, the color component of the ink is thickened and the drying of the ink is accelerated to prevent bleeding (feathering, bleeding, or the like) or strike-through, and it is possible to enhance productivity (the number of images output per unit time).

Compositionally, as the treatment liquid, for example, a solution can be used in which cellulose (for example, hydroxypropyl cellulose) that promotes penetration of moisture and a base material, such as talc fine powder, are added to surfactant (for example, any one of anionic, cationic, and nonionic surfactants, or a mixture, of two or more of the foregoing surfactants).

The treatment liquid may also contain fine particles.

The application device 510 of the present variation includes a conveyance roller 511 to convey the sheet, an application roller 512 to apply a treatment liquid 501 to the sheet to face the conveyance roller 511, and a squeeze roller 513 to supply the treatment liquid 501 to the application roller 512 to thin the liquid film (the film of the treatment liquid 501). The directions of rotation of the conveyance roller 511, the application roller 512, and the squeeze roller 513 are indicated by arrows R2, R3, and R4 in FIG. 10. In these rollers, the application roller 512 is disposed in contact with the conveyance roller 511, and the squeeze roller 513 is disposed in contact with the application roller 512.

In the present variation, when the treatment liquid 501 is applied to the sheet P by the application device 510, by the rotation of the squeeze roller 513 in the counter clockwise direction indicated by arrow in FIG. 10, the treatment liquid 501 in the liquid tray 514 is scooped up by the surface of the squeeze roller 513, is transferred in the state of the liquid film layer 501*a* by the rotation, and is accumulated on a valley portion (contact portion: nipping portion) between the squeeze roller 513 and the application roller 512 (treatment liquid 501*b*).

Here, the squeeze roller 513 and the application roller 512 are in contact with each other at a constant pressing force. When the treatment liquid 50th stored in the valley portion passes between the squeeze roller 513 and the application roller 512, the treatment liquid 501*b* is squeezed by pressure. A liquid film layer 501*c* of the treatment liquid 501 is formed and is conveyed to the conveyance roller 511 side by the rotation of the application roller 512. The liquid film layer 501*c* transferred by the application roller 512 is applied to the sheet P.

The sheet applied with the liquid film layer 541*c* of the treatment liquid 501 in such a manner is conveyed to the drying unit 300' having substantially the same configuration as the drying unit 300 of the above-described embodiment, and the drying process is performed on this sheet P. The sheet P having been subjected to the drying process by the drying unit 300' is fed to the image forming unit 200, and an image is formed by discharging of ink in the image forming unit 200.

Figure 11:
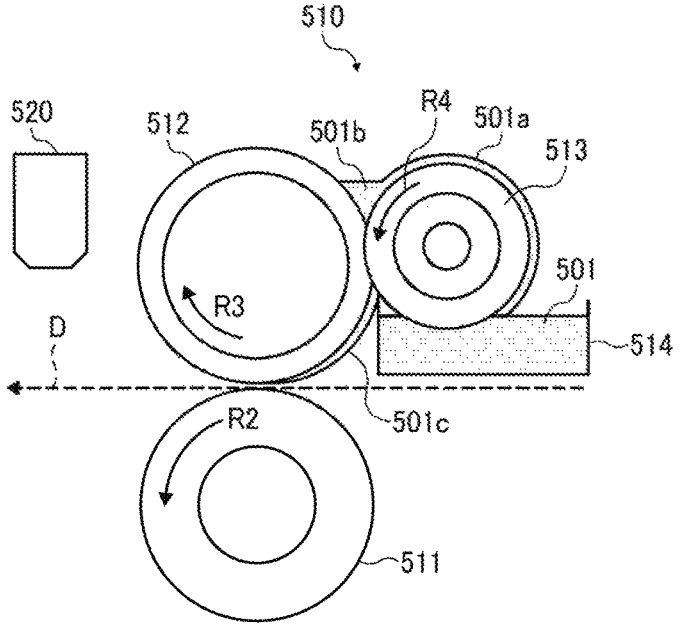
FIG. 11 is a schematic cross-sectional view of mother embodiment of the application device used in the inkjet recording apparatus.

In the present variation, as illustrated in FIG. 11, an exposure light source 520 as exposure device to emit active, energy rays, such as ultraviolet rays, may be disposed downstream from the application device 510 in the sheet conveyance direction D illustrated by arrow in broken line. Accordingly, after the treatment liquid 501 is applied to the sheet P, the treatment liquid 501 are irradiated with the active energy rays and are partially cured (semi-cured). Then, the treatment liquid 501 is dried in the drying unit 300'. The present variation is particularly effective in a case in which the treatment liquid 501 contains a photo-polymerization initiator described below and has a relatively high content of moisture.

In such a case, the treatment liquid 501 preferably contains a photo-polymerization initiator. The photo-polymerization initiator is preferably a photo-radical polymerization initiator. Examples of the photo-polymerization initiator include, but are not limited to, aromatic ketones, phosphine oxide compounds, aromatic onium salt compounds, organic peroxides, thio compounds, hexaaryl biimidazole compounds, ketoxime ester compounds, borate compounds, azinium compounds, metallocene compounds, active ester compounds, carbon-halogen-bond-containing compounds, and alkylamine compounds.

Examples of the active energy ray include, but are not limited to, ultraviolet ray, visible light, α-ray, γ-ray, X-ray, and electron ray. Examples of the exposure light source 520 to emit the active energy ray include, but are not limited to, a mercury lamp, a metal halide lamp, a light emitting diode, and a laser diode.

In the present variation, the drying unit 300' is disposed between the pre-processing unit 500 and the image forming unit 200. The sheet P applied with the treatment liquid 501 by the application device 510 of the pre-processing unit 500 is dried before ink is discharged to form an image in the image forming unit 200, However, the arrangement is not limited to the example of the present variation.

Figure 12:
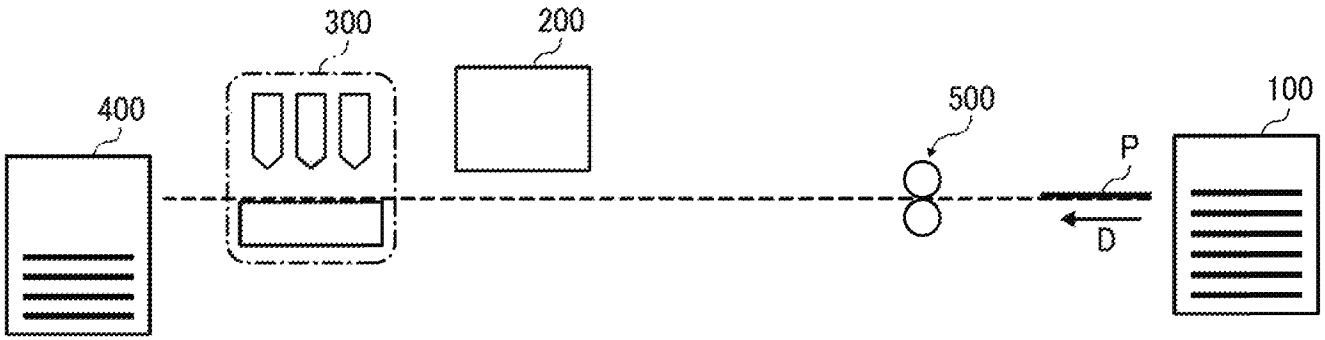
FIG. 12 is a schematic view of still another embodiment of the inkjet recording apparatus.

For example, as illustrated in FIG. 12, no drying unit may be disposed between the pre-processing unit 500 and the image forming unit 200. The drying unit 300 disposed downstream from the image forming unit 200 in the sheet conveyance direction D indicated by arrow in FIG. 12 may collectively dry the treatment liquid 501 applied by the application device 510 of the pre-processing unit 500 and ink discharged by the image forming unit 200. Note that, in a case in which the treatment liquid 501 containing a photo-polymerization initiator is used, the exposure light source 520 illustrated in FIG. 11 may he disposed between the image forming unit 200 and the drying unit 300.

The structures described above are just examples, and the various aspects of the present specification attain respective effects as follows.

Aspect A

A conveyance apparatus (drying unit 300) includes a conveyance device 302 including a sheet-bearing member (drum 320) having a curved sheet-bearing surface (outer circumferential surface of the drum 320). The conveyance device 302 conveys the sheet P by supporting the sheet P on one side with the curved sheet-bearing surface of the sheet-bearing member (drum 320). The conveyance apparatus (drying unit 300) includes a blower (blower fan 311) to blow the air onto the sheet P. The curved sheet-bearing surface of the sheet-bearing member (drum 320) is formed by a plurality of wires 322 defining gaps 326 through which the blower (blower fan 311) blows air.

According to the Aspect A, the air that strikes the circumference of the sheet P borne by the sheet-bearing surface of the sheet-bearing member (drum 320) can pass through the gaps 326 between the plurality of wires that form the sheet-bearing member. Thereby, the Aspect A can prevent the air that hits the sheet-bearing member (drum 320) and flows along the sheet-bearing surface.

Thus, the Aspect A can prevent this air to enter into the back side of the sheet P and cause the curling up and flapping of the sheet P. Thus, the conveyance apparatus of the Aspect A achieves a stable sheet conveyance.

Aspect B

In the above-described Aspect A, the sheet-bearing member (drum 320) is an endless moving member such as drum (drum 320) or belt, and the curved sheet-bearing surface is an outer circumferential surface of the endless moving member (drum 320). Thus, the conveyance apparatus of the Aspect B that bears the sheet P on the outer circumferential surface of the endless moving member achieves a stable sheet conveyance.

Aspect C

In the above-described Aspect A or B, the conveyance apparatus (drying, unit 300) includes a flow-channel forming member (straightening vanes 324*a* to 324*c*) that forms a channel that guides the air that passes through gaps 326 disposed between the pluralities of wires (supporting wires 322) toward a predetermined destination (entrance of the discharge duct 325).

The Aspect C can reduce bad influence caused by the air that passes through the gaps 326 between the plurality of supporting wires 322 from the circumference of the sheet P.

Aspect D

In the above-described aspect B, the conveyance apparatus (drying unit 300) includes a flow-channel forming member (straightening vanes 324*a* to 324*c*) that forms a channel that guides the air that enters an interior space of the endless moving member (drum 320) by passing through gaps 326 disposed between the pluralities of wires (supporting wires 322) toward an non-bearing portion of the endless moving member (drum 320) on which the sheet P not borne.

The aspect D can prevent the air that passes through the gaps 326 between the plurality of wires and hits the sheet-bearing member (drum 320) where the sheet P is borne from the back side of the sheet P. The aspect D thereby achieves a stable sheet conveyance.

Aspect E

In the above-described Aspects A through D), the endless moving member (drum 320) has a rotational body to convey the sheet P. The blower (blower fan 311) blows the air toward a portion of the curved sheet-bearing surface disposed lower than a rotational axis of the rotational body.

Thus, the conveyance apparatus (drying unit 300) of the Aspect E can achieve a stable sheet conveyance.

Aspect F

In any one of above-described Aspects C through E, the conveyance apparatus (drying unit 300) includes an irradiation heater 312 that irradiates radiant heat to the sheet P.

The Aspect F can provide the air with high temperature heat to the sheet P by the blower (blower fan 311). Further, in the Aspect F, a heat capacity of the sheet-bearing member (drum 320) is small, and a total surface area is large because the sheet-hearing surface of the sheet-bearing member (drum 320) of the aspect F is configured by a plurality of wires that are separately disposed with each other.

Therefore, the Aspect F can reduce a temperature increase of the sheet-bearing surface of the sheet-bearing member (drum 320) even when the high-temperature air hits on the sheet-bearing member (drum 320).

Aspect G

Figure 7:
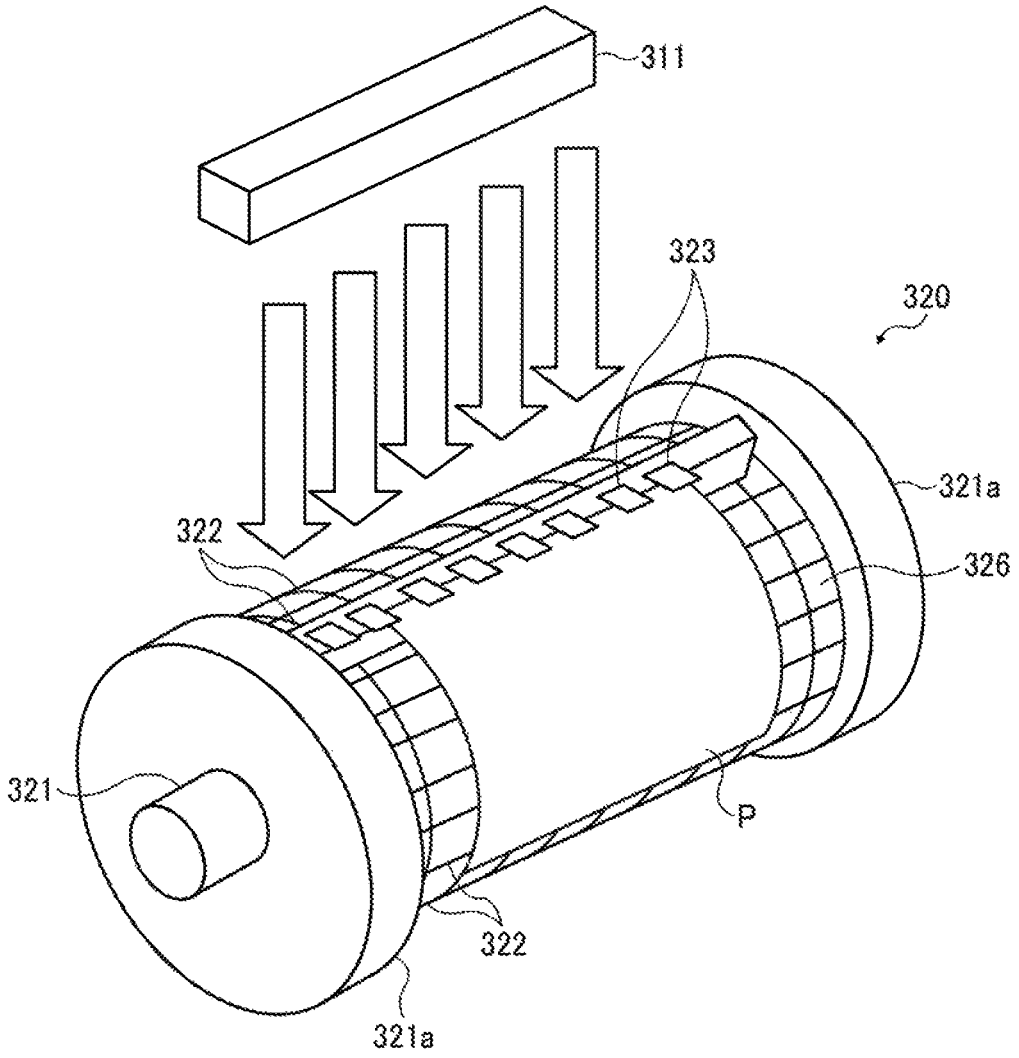
FIG. 7 is perspective view of the drying unit illustrated in FIG. 6.

In any one of the above-described Aspects A through F, the plurality of wires (supporting wires 322) has a mesh structure as illustrated in FIGS. 6 to 7.

Thus, the conveyance apparatus (drying unit 300) can achieve a stable sheet conveyance.

Aspect H

A printing apparatus (inkjet recording apparatus 1) includes a liquid discharge unit (liquid discharge heads 220C, 220M, 220Y, and 220K) to discharge liquid onto a sheet P and a conveyance apparatus (drying unit 300) to convey the sheet P on which the liquid is discharged by the liquid discharge unit (liquid discharge heads 220C, 220M, 220Y, and 220K) while the air is blown onto the sheet P.

The conveyance apparatus (drying unit 300) includes a conveyance device 302 including a sheet-bearing member (drum 320) having a curved sheet-bearing surface. The conveyance device 302 conveys the sheet P by bearing one surface of a sheet P with the curved sheet-bearing surface of the sheet-bearing member (drum 320).

The conveyance apparatus (drying unit 300) includes a blower (blower fan 311) to blow the air onto the sheet P. The curved sheet-bearing surface of the sheet-bearing member (drum 320) includes a plurality of wires (supporting wires 322) having gaps 326 disposed between the plurality of wires 322 so that the air blown from the blower (blower fan 311) to the sheet P is passable through the gaps 326.

Thus, the printing apparatus (inkjet recording apparatus 1) can achieve a stable sheet conveyance in the conveyance apparatus (drying unit 300).

Aspect I

A printing apparatus (inkjet recording apparatus 1) includes a liquid discharge unit 220 (liquid discharge heads 220G, 220M, 220Y, and 220K) to discharge liquid onto a sheet P, a pre-processing unit (application device 510) to apply treatment liquid 501 to the sheet P before the liquid, is discharged onto the sheet P at an upstream side from the liquid discharge unit 220 (liquid discharge heads 220G, 220M, 220Y, and 220K) in a sheet conveyance direction D, and a conveyance apparatus (drying unit 300) to convey the sheet on which the treatment liquid is discharged by the pre-processing unit (application device 510) while the air is blown onto the sheet P.

The conveyance apparatus (drying unit 300) includes a conveyance device including a sheet-bearing member (drum 320) having a curved sheet-bearing surface. The conveyance device 302 conveys the sheet P by bearing one surface of a sheet P with the curved sheet-bearing surface of the sheet-bearing member (drum 320).

The conveyance apparatus (drying unit 300) includes a blower (blower fan 311) to blow the air onto the sheet P. The curved sheet-bearing surface of the sheet-bearing member (drum 320) includes a plurality of wires (supporting wires 322) having gaps 326 disposed between the plurality of wires 322 so that the air blown from the blower (blower fan 311) to the sheet P is passable through the gaps 326.

Thus, the printing apparatus (inkjet recording apparatus 1) can achieve a stable sheet conveyance in the conveyance apparatus (drying unit 300).

Numerous additional modifications and variations are possible in light of the above teachings, It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope (if the present disclosure and appended claims.

What is claimed is:

1. A conveyance apparatus, comprising:

a conveyance device including a sheet-bearing member having a curved sheet-bearing surface, the conveyance device conveying a sheet by bearing the sheet with the curved sheet-bearing surface of the sheet-bearing member; and a blower to blow air onto the sheet, wherein the curved sheet-bearing surface of the sheet-bearing member is formed by a plurality of wires defining gas through which the blower blows air.

2. The conveyance apparatus according to claim 1, wherein the sheet-bearing member is an endless moving member; and the curved sheet-hearing surface is an outer circumferential surface of the endless moving member.

3. The conveyance apparatus according to claim 2, further comprising vanes located within the endless moving member that form a channel that guides the air through the gaps.

4. The conveyance apparatus according to claim 3, wherein the channel guides the air entered inside the endless moving member to a portion of the endless moving member where the sheet is not borne.

5. The conveyance apparatus according to claim 2, wherein the endless moving member is a rotational both that conveys the sheet; and the blower blows the air toward a portion of the curved sheet-bearing surface disposed below a rotational axis of the rotational body.

6. The conveyance apparatus according to claim 1, further comprising an irradiation heater that irradiates the sheet with radiant heat.

7. The conveyance apparatus according to claim 1, wherein the cured sheet-bearing surface of the sheet-bearing member is firmed by wire mesh.

8. A printing apparatus comprising:

a liquid discharge unit to discharge liquid onto a sheet; and the conveyance apparatus of claim 1.

9. A printing apparatus comprising:

a liquid discharge unit to discharge liquid onto a sheet;

a pre-processing unit to apply treatment liquid to the sheet before the discharged onto the sheet; and the conveyance apparatus of claim 1.

* * * * *